US009841707B2

(12) United States Patent
Kuroda et al.

(10) Patent No.: US 9,841,707 B2
(45) Date of Patent: Dec. 12, 2017

(54) IMAGE FORMING APPARATUS, CONTROL METHOD, AND CONTROL PROGRAM IN WHICH A MAGNITUDE OF A CURRENT TO FLOW IN A PAPER SHEET AT THE TIME OF TONER IMAGE TRANSFER CAN BE SET

(71) Applicant: Konica Minolta, Inc., Tokyo (JP)

(72) Inventors: Takahiro Kuroda, Toyokawa (JP); Kanji Nakayama, Toyokawa (JP); Kohei Hayashi, Okazaki (JP); Tatsutoshi Yamada, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/377,413

(22) Filed: Dec. 13, 2016

(65) Prior Publication Data

US 2017/0176895 A1 Jun. 22, 2017

(30) Foreign Application Priority Data

Dec. 21, 2015 (JP) ..... 2015-248686

(51) Int. Cl.
*G03G 15/16* (2006.01)

(52) U.S. Cl.
CPC ..... *G03G 15/1665* (2013.01)

(58) Field of Classification Search
CPC ..... G03G 15/1665; G03G 15/1675
USPC ..... 399/66
See application file for complete search history.

(56) References Cited

U.S. PATENT DOCUMENTS 6,456,804 B2 * 9/2002 Izawa et al. ..... G03G 15/1675 399/66

FOREIGN PATENT DOCUMENTS

JP 2010145955 A 7/2010

* cited by examiner

*Primary Examiner* — William J Royer
(74) *Attorney, Agent, or Firm* — Lucas & Mercanti, LLP

(57) ABSTRACT

An image forming apparatus includes: an image carrier configured to carry a toner image; a transfer member configured to transfer the toner image onto a transfer target member by applying a transfer voltage of the opposite polarity of the polarity of the toner image to the transfer target member, the transfer member being in contact with the image carrier; an accepting unit configured to accept a setting for changing a preset current range to a new current range, the preset current range being defined by one of a lower limit of a current flowing in the transfer target member and an upper limit of the current; a sensing unit configured to sense a magnitude of the current flowing in the transfer target member; and a control device configured to control the transfer voltage so that the magnitude of the sensed current falls within the new current range.

15 Claims, 9 Drawing Sheets

FIG. 8

124

| PRINTING CONDITIONS | | | | | | CURRENT ADJUSTMENT AMOUNT | | VOLTAGE ADJUSTMENT AMOUNT | |
|---|---|---|---|---|---|---|---|---|---|
| SHEET CONVEYANCE SPEED | SHEET TYPE | PRINTING SIDE | SHEET WIDTH | COVERAGE | ENVIRONMENT | LOWER LIMIT | UPPER LIMIT | LOWER LIMIT | UPPER LIMIT |
| 150mm/s | PLAIN PAPER | FRONT SIDE | 100mm OR LESS | 0 TO 20% | HH ENVIRONMENT (TEMPERATURE: 30°C, HUMIDITY: 85%) | 5μA | 30μA | 200V | 50V |
| ⋮ | ⋮ | ⋮ | ⋮ | ⋮ | ⋮ | ⋮ | ⋮ | ⋮ | ⋮ |

IMAGE FORMING APPARATUS, CONTROL METHOD, AND CONTROL PROGRAM IN WHICH A MAGNITUDE OF A CURRENT TO FLOW IN A PAPER SHEET AT THE TIME OF TONER IMAGE TRANSFER CAN BE SET

The entire disclosure of Japanese Patent Application No. 2015-248686 filed on Dec. 21, 2015 including description, claims, drawings, and abstract are incorporated herein by reference in its entirety.

BACKGROUND OF THE INVENTION

Field of the Invention

The present disclosure relates to control of an image forming apparatus, and more particularly, relates to control of electrophotographic image forming apparatus.

Description of the Related Art

Electrophotographic image forming apparatuses are widely used today. An electrophotographic image forming apparatus performs a printing process that includes a process of forming a toner image on an image carrier such as a photosensitive member or an intermediate transfer member, a process of transferring the toner image from the image carrier onto a paper sheet, and a process of fixing the toner image to the paper sheet.

The transfer of a toner image from an image carrier onto a paper sheet is performed by a transfer member. The transfer member is installed in contact with the image carrier. A voltage of the opposite polarity of that of the toner image (this voltage will be hereinafter also referred to as "transfer voltage") is applied to the transfer member. With this transfer voltage, the toner image is attracted to the transfer member from the image carrier, and is then transferred onto the paper sheet being conveyed between the image carrier and the transfer member.

The resistance value of the transfer member varies with the surrounding environment or the like. Furthermore, the resistance value of a paper sheet varies with the type of the paper sheet. With such changes, the transfer voltage to be applied to the transfer member might also change, and cause a decrease in print quality. Particularly, unlike the resistance value of plain paper, the resistance value of a paper sheet to be used to achieve special image quality or a special visual or tactile effect (such a paper sheet will be hereinafter also referred to as "special paper") noticeably reflects a decrease in print quality. To increase the print quality of special paper, the user of the image forming apparatus manually sets an allowable range of change in the transfer voltage for the special paper. In relation to a technology for reducing the load of this setting process, JP 2010-145955 A discloses an image forming apparatus for simplifying the operation to set the transfer voltage for special paper.

When an image carrier and a transfer member are left in an environment where ozone is readily generated or at an ultralow temperature for a long period of time, the resistance values of the image carrier and the transfer member might become higher than expected. As a result, current does not smoothly flow in paper sheets. Furthermore, in a case where printing is performed on a paper sheet with an unexpectedly high resistance value (such as a paper sheet with poor quality), current does not smoothly flow in the paper sheet. In such a case, even if the transfer voltage is finely adjusted, the current flowing in a paper sheet does not greatly change, and therefore, the print quality of the paper sheet does not greatly change, either. In view of this, in the image forming apparatus disclosed in JP 2010-145955 A, the user or maintenance staff needs to set a wide allowable range of transfer voltage change, and conduct test printing repeatedly to achieve desired print quality. In such circumstances, there is a demand for an image forming apparatus in which the magnitude of the current to flow in the paper sheet at the time of printing can be set, instead of the transfer voltage that hardly affects print quality.

SUMMARY OF THE INVENTION

The present disclosure has been made to solve the above problems, and an object thereof is to provide an image forming apparatus in which the magnitude of the current to flow in the paper sheet at the time of toner image transfer can be set. Another object of the present disclosure is to provide a method of controlling an image forming apparatus in which the magnitude of the current to flow in the paper sheet at the time of toner image transfer can be set. Yet another object of the present disclosure is to provide a program for controlling an image forming apparatus in which the magnitude of the current to flow in the paper sheet at the time of toner image transfer can be set.

To achieve at least one of the abovementioned objects, according to an aspect, an image forming apparatus reflecting one aspect of the present invention comprises: an image carrier configured to carry a toner image; a transfer member configured to transfer the toner image from the image carrier onto a transfer target member by applying a transfer voltage of the opposite polarity of the polarity of the toner image to the transfer target member passing through a portion in contact with the image carrier, the transfer member being in contact with the image carrier; an accepting unit configured to accept a setting for changing a preset current range to a new current range, the preset current range being defined by at least one of a lower limit of a current flowing in the transfer target member passing through the contact portion between the image carrier and the transfer member and an upper limit of the current; a sensing unit configured to sense a magnitude of the current flowing in the transfer target member passing through the contact portion between the image carrier and the transfer member; and a control device configured to control the transfer voltage so that the magnitude of the current sensed by the sensing unit falls within the new current range.

The image forming apparatus preferably has a setting mode as an operation mode, and the accepting unit preferably accepts a change of the preset current range while the operation mode is the setting mode.

The accepting unit preferably accepts a change of the preset current range by accepting at least one of a new lower limit of the current and a new upper limit of the current.

The control device preferably gradually changes the transfer voltage from a predetermined initial voltage so that the magnitude of the current flowing between the transfer member and the image carrier falls within the new current range, and a magnitude of the initial voltage preferably varies with a change of the preset current range.

The image forming apparatus preferably further comprises a storage device storing printing information, the printing information being voltage adjustment amounts associated with a plurality of sets of printing conditions, the sets being different from one another, and the control device preferably obtains, from the printing information, the voltage adjustment amount associated with the set of the printing conditions for the transfer target member to be subjected to printing, and changes the transfer voltage by the voltage adjustment amount each time so that the magnitude of the current flowing between the transfer member and the image carrier falls within the new current range.

To achieve at least one of the abovementioned objects, according to an aspect, there is provided a method of controlling an image forming apparatus, the image forming apparatus including: an image carrier configured to carry a toner image; and a transfer member configured to transfer the toner image from the image carrier onto a transfer target member by applying a transfer voltage of the opposite polarity of the polarity of the toner image to the transfer target member passing through a portion in contact with the image carrier, the transfer member being in contact with the image carrier, and the method reflecting one aspect of the present invention comprises: a step of accepting a setting for changing a preset current range to a new current range, the preset current range being defined by at least one of a lower limit of a current flowing in the transfer target member passing through the contact portion between the image carrier and the transfer member and an upper limit of the current; a step of sensing a magnitude of the current flowing in the transfer target member passing through the contact portion between the image carrier and the transfer member; and a step of controlling the transfer voltage so that the magnitude of the current sensed by the sensing unit falls within the new current range.

The image forming apparatus preferably has a setting mode as an operation mode, and the accepting step preferably includes accepting a change of the preset current range while the operation mode is the setting mode.

The accepting step preferably includes accepting a change of the preset current range by accepting at least one of a new lower limit of the current and a new upper limit of the current.

The controlling step preferably includes gradually changing the transfer voltage from a predetermined initial voltage so that the magnitude of the current flowing between the transfer member and the image carrier falls within the new current range, and a magnitude of the initial voltage preferably varies with a change of the preset current range.

The image forming apparatus preferably further includes a storage device storing printing information, the printing information being voltage adjustment amounts associated with a plurality of sets of printing conditions, the sets being different from one another, and the controlling step preferably includes obtaining, from the printing information, the voltage adjustment amount associated with the set of the printing conditions for the transfer target member to be subjected to printing, and changing the transfer voltage by the voltage adjustment amount each time so that the magnitude of the current flowing between the transfer member and the image carrier falls within the new current range.

To achieve at least one of the abovementioned objects, according to an aspect, there is provided a non-transitory recording medium storing a computer readable program for controlling an image forming apparatus, the image forming apparatus including: an image carrier configured to carry a toner image; and a transfer member configured to transfer the toner image from the image carrier onto a transfer target member by applying a transfer voltage of the opposite polarity of the polarity of the toner image to the transfer target member passing through a portion in contact with the image carrier, the transfer member being in contact with the image carrier, and the control program reflecting one aspect of the present invention causes the image forming apparatus to carry out: a step of accepting a setting for changing a preset current range to a new current range, the preset current range being defined by at least one of a lower limit of a current flowing in the transfer target member passing through the contact portion between the image carrier and the transfer member and an upper limit of the current; a step of sensing a magnitude of the current flowing in the transfer target member passing through the contact portion between the image carrier and the transfer member; and a step of controlling the transfer voltage so that the magnitude of the current sensed by the sensing unit falls within the new current range.

The image forming apparatus preferably has a setting mode as an operation mode, and the accepting step preferably includes accepting a change of the preset current range while the operation mode is the setting mode.

The accepting step preferably includes accepting a change of the preset current range by accepting at least one of a new lower limit of the current and a new upper limit of the current.

The controlling step preferably includes gradually changing the transfer voltage from a predetermined initial voltage so that the magnitude of the current flowing between the transfer member and the image carrier falls within the new current range, and a magnitude of the initial voltage preferably varies with a change of the preset current range.

The image forming apparatus preferably further includes a storage device storing printing information, the printing information being voltage adjustment amounts associated with a plurality of sets of printing conditions, the sets being different from one another, and the controlling step preferably includes obtaining, from the printing information, the voltage adjustment amount associated with the set of the printing conditions for the transfer target member to be subjected to printing, and changing the transfer voltage by the voltage adjustment amount each time so that the magnitude of the current flowing between the transfer member and the image carrier falls within the new current range.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 8 is a table showing the contents of printing information;

DESCRIPTION OF THE PREFERRED EMBODIMENTS

Figure 1:
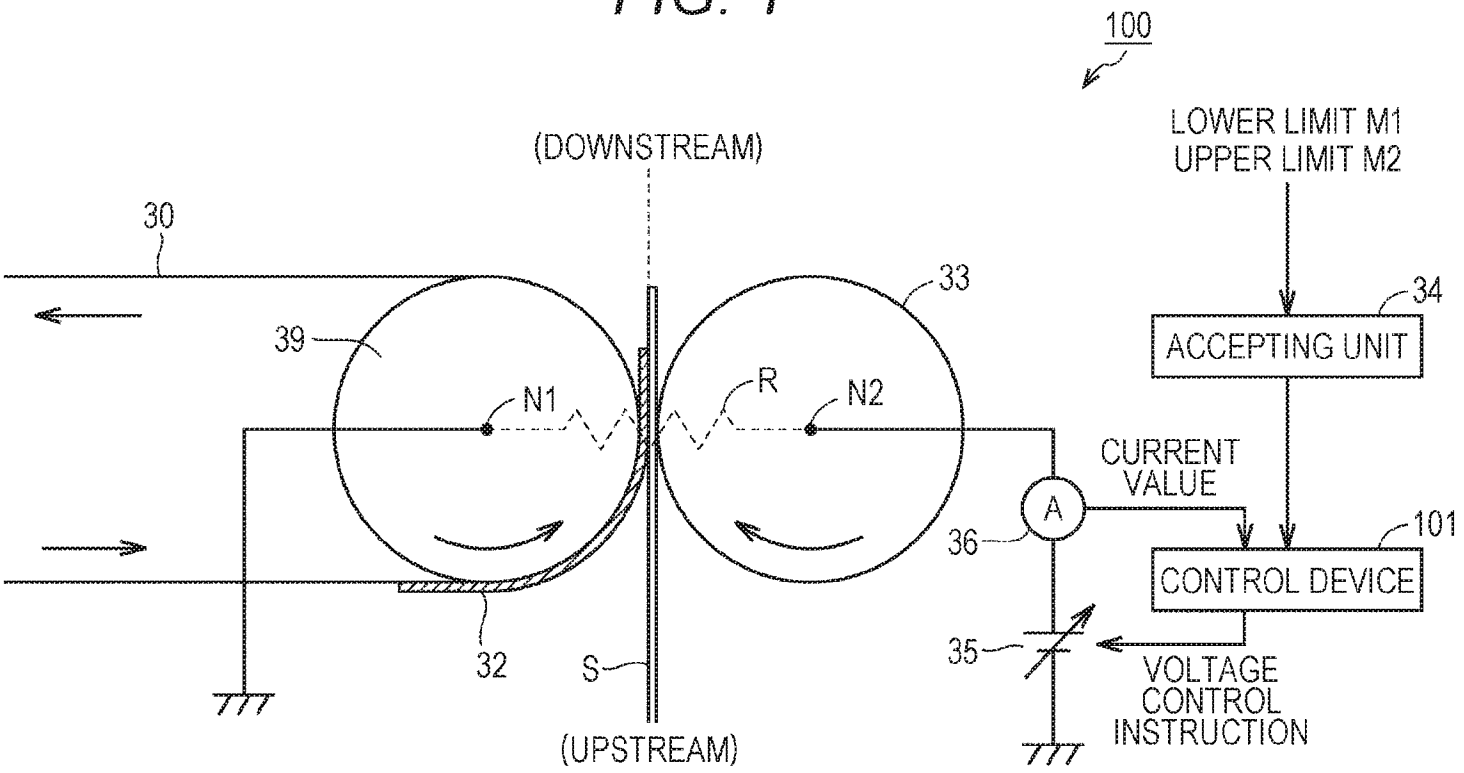
FIG. 1 is a diagram showing a configuration for performing secondary transfer of a toner image from an intermediate transfer belt onto a paper sheet.

Hereinafter, an embodiment of the present invention will be described with reference to the drawings. However, the scope of the invention is not limited to the illustrated examples. In the description below, like components and constituent elements are denoted by like reference numerals. Like components and constituent elements also have like names and functions. Therefore, detailed explanation of them will not be unnecessarily repeated. It should be noted that the embodiments and the modifications described below may be selectively combined as appropriate.

The above and other objects, features, aspects, and advantages of the present invention will become apparent from the detailed description given below in relation to the present invention to be understood in conjunction with the accompanying drawings.

[Secondary Transfer Process]

An electrophotographic image forming apparatus 100 performs a printing process that includes a process of forming a toner image on a photosensitive member, a process of transferring the toner image from the photosensitive member onto an intermediate transfer belt as a primary transfer process, and a process of transferring the toner image from the intermediate transfer belt onto a paper sheet as a secondary transfer process.

Referring now to FIG. 1, the secondary transfer process to be performed for a toner image 32 by the image forming apparatus 100 is described. FIG. 1 is a diagram showing a configuration for performing secondary transfer of the toner image 32 from an intermediate transfer belt 30 onto a paper sheet S. The primary transfer process will be described later.

As shown in FIG. 1, the image forming apparatus 100 includes the intermediate transfer belt 30, a secondary transfer member 33, an accepting unit 34, a voltage source 35, a sensing unit 36, a driving roller 39, and a control device 101.

The intermediate transfer belt 30 is an image carrier for carrying the toner image 32. The intermediate transfer belt 30 is stretched around the later described following roller 38 (see FIG. 2) and the driving roller 39. Receiving a drive force from the driving roller 39, the intermediate transfer belt 30 rotates to convey the toner image 32 to the secondary transfer member 33. Although FIG. 1 shows the intermediate transfer belt 30 as an example of the image carrier, the image carrier may be a later described photosensitive member 10 (see FIG. 2).

The secondary transfer member 33 (the transfer member) is installed in contact with the intermediate transfer belt 30. The secondary transfer member 33 applies a transfer voltage of the opposite polarity of that of the toner image 32 to the paper sheet S (a transfer target member) passing through the portion in contact with the intermediate transfer belt 30, so that the toner image 32 on the intermediate transfer belt 30 is transferred onto the paper sheet S. With the application of the transfer voltage, the toner image 32 is attracted to the secondary transfer member 33 from the intermediate transfer belt 30, and is then transferred onto the paper sheet S being conveyed between the image carrier and the transfer member. Although FIG. 1 shows the secondary transfer member 33 as an example of the transfer member, the transfer member may be a later described primary transfer member 31 (see FIG. 2). Although FIG. 1 shows the paper sheet S as an example of a transfer target member onto which a toner image is to be transferred, the transfer target member may be some other kind of sheet.

The accepting unit 34 accepts a setting to change a preset current range to a new current range. The preset current range is defined by a lower limit M1 of the current flowing in the paper sheet S passing through the contact portion between the intermediate transfer belt 30 and the secondary transfer member 33 (this current will be hereinafter also referred to as "transfer current"), and/or an upper limit M2 of the transfer current. The accepting unit 34 will be described later with reference to FIG. 3.

The voltage source 35 applies a voltage to the intermediate transfer belt 30 and the secondary transfer member 33. The voltage source 35 is a variable voltage source, and outputs a different voltage in accordance with a voltage control instruction from the control device 101. The voltage source 35 is electrically connected to a node N2 of the secondary transfer member 33 and ground, and is located between the node N2 and the ground.

The intermediate transfer belt 30, the secondary transfer member 33, and the driving roller 39 are in contact with one another between nodes N1 and N2, and the nodes N1 and N2 are connected to the ground. Accordingly, a transfer voltage corresponding to a resistance R between the nodes N1 and N2 is generated in the paper sheet S. As a result, a transfer current flows between the intermediate transfer belt 30 and the secondary transfer member 33. The sensing unit 36 senses the magnitude of the transfer current flowing in the paper sheet S passing through the contact portion between the intermediate transfer belt 30 and the secondary transfer member 33. The sensing unit 36 is a current sensor, for example. The magnitude of the transfer current is represented by a current value, for example.

The control device 101 controls the transfer voltage so that the magnitude of the transfer current to be sensed by the sensing unit 36 falls within the current range that is set as described above. More specifically, when the magnitude of the transfer current is smaller than the lower limit M1, the control device 101 issues a voltage control instruction for increasing the transfer voltage at this point of time, to the voltage source 35. When the magnitude of the transfer current is greater than the upper limit M2, the control device 101 issues a voltage control instruction for lowering the transfer voltage to the voltage source 35. The control device 101 repeats the sensing of the transfer current and the control of the transfer voltage until the transfer current falls within the current range.

In the above manner, the image forming apparatus 100 accepts a setting of a current range. In a case where printing is to be performed on a paper sheet with an unexpectedly high resistance value (a paper sheet with poor quality, for example), print quality can be more efficiently controlled with a change in the transfer current than with a change in the transfer voltage. Accordingly, the user of the image forming apparatus 100 and the maintenance staff for the image forming apparatus 100 can greatly change print quality by setting a current range. In this manner, the number of times test printing needs to be performed to achieve desired print quality can be reduced. Thus, the workload can be reduced.

[Inner Structure of the Image Forming Apparatus 100]

Figure 2:
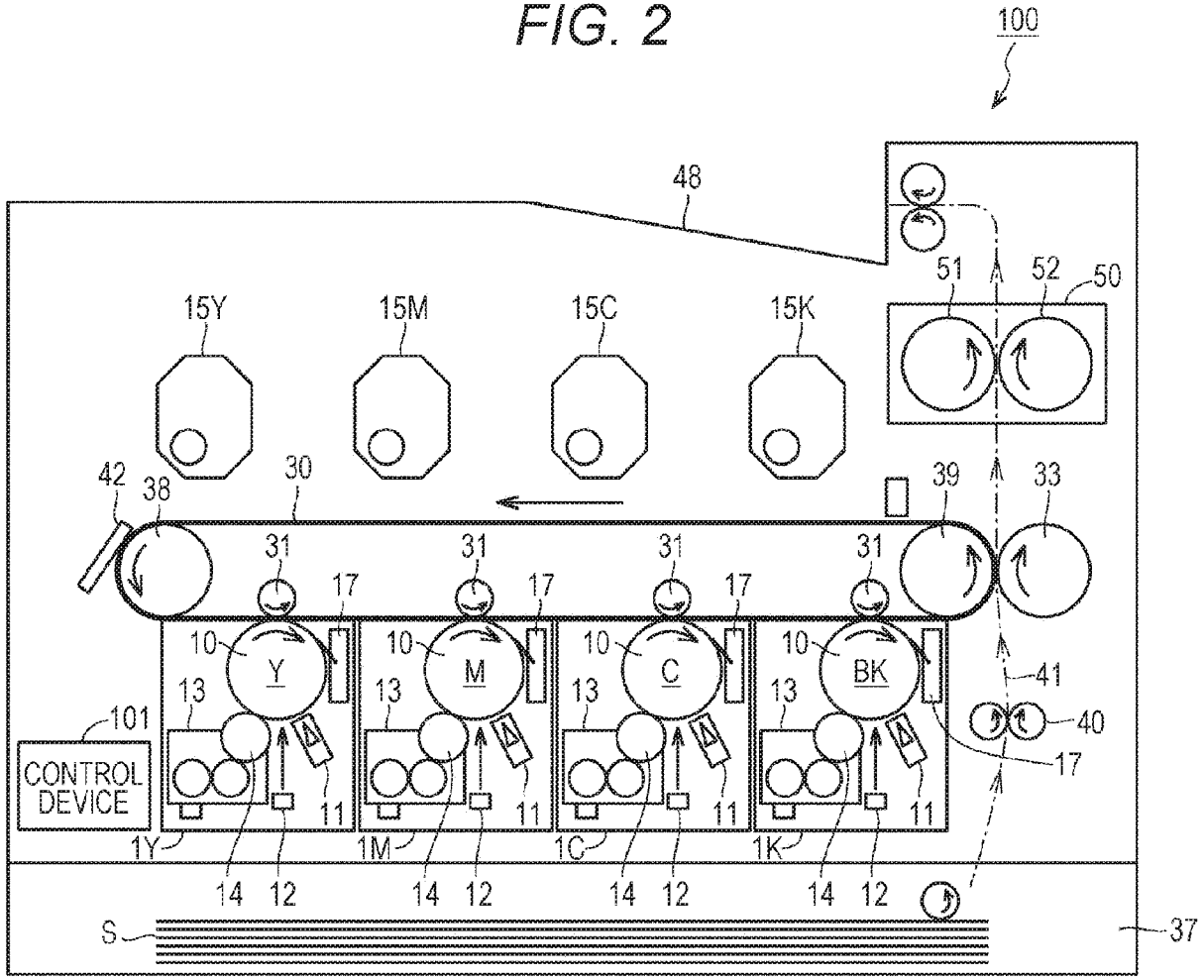
FIG. 2 is a diagram showing the inner structure of an image forming apparatus.

Referring now to FIG. 2, the image forming apparatus 100 is described. FIG. 2 is a diagram showing the inner structure of the image forming apparatus 100.

The image forming apparatus 100 as a color printer is shown in FIG. 2. Although the image forming apparatus 100 as a color printer will be described below, the image forming apparatus 100 is not necessarily a color printer. For example, the image forming apparatus 100 may be a monochrome printer, a facsimile machine, or multifunctional peripherals (MFP) that function as a monochrome printer, a color printer, and a facsimile machine.

The image forming apparatus 100 includes image forming units 1Y, 1M, 1C, and 1K, the intermediate transfer belt 30, the primary transfer member 31, the secondary transfer member 33, a cassette 37, the following roller 38, the driving roller 39, timing rollers 40, a fixing device 50, a cleaning blade 42, and the control device 101.

The image forming unit 1Y receives a supply of toner from a toner bottle 15Y, and forms a yellow (Y) toner image. The image forming unit 1M receives a supply of toner from a toner bottle 15M, and forms a magenta (M) toner image. The image forming unit 1C receives a supply of toner from a toner bottle 15C, and forms a cyan (C) toner image. The image forming unit 1K receives a supply of toner from a toner bottle 15K, and forms a black (BK) toner image.

The image forming units 1Y, 1M, 1C, and 1K are arranged along the intermediate transfer belt 30 in the direction of rotation of the intermediate transfer belt 30. The image forming units 1Y, 1M, 1C, and 1K each include a photosensitive member 10, a charging unit 11, an exposing unit 12, a developing unit 13, and a cleaning blade 17.

The charging unit 11 uniformly charges the surface of the photosensitive member 10. The exposing unit 12 emits laser light onto the photosensitive member 10 in accordance with a control signal from the control device 101, and exposes the surface of the photosensitive member 10 in accordance with an image pattern that has been input. As a result, an electrostatic latent image corresponding to the input image is formed on the photosensitive member 10.

The developing unit 13 applies a developing bias to a developing roller 14 while rotating the developing roller 14, so that toner adheres to the surface of the developing roller 14. The toner is then transferred from the developing roller 14 onto the photosensitive member 10, and a toner image corresponding to the electrostatic latent image is developed on the surface of the photosensitive member 10.

The photosensitive member 10 and the intermediate transfer belt 30 are in contact with each other at the portion where the primary transfer member 31 is provided. The primary transfer member 31 is in the form of a roller, and is designed to rotate. As a transfer voltage of the opposite polarity of that of the toner image is applied to the primary transfer member 31, the toner image is transferred from the photosensitive member 10 onto the intermediate transfer belt 30. The yellow (Y) toner image, the magenta (M) toner image, the cyan (C) toner image, and the black (BK) toner image are sequentially transferred from the photosensitive member 10 onto the intermediate transfer belt 30 in an overlapping manner. As a result, a color toner image is formed on the intermediate transfer belt 30.

The intermediate transfer belt 30 is stretched around the following roller 38 and the driving roller 39. The driving roller 39 is connected to a motor (not shown). The motor is controlled by the control device 101, for example. The method of controlling the motor may be pulse width modulation (PWM) control, for example. As the control device 101 controls the motor, the driving roller 39 rotates. The intermediate transfer belt 30 and the following roller 38 rotate with the driving roller 39. As a result, the toner image on the intermediate transfer belt 30 is conveyed to the secondary transfer member 33.

The cleaning blade 17 is pressed against the photosensitive member 10. The cleaning blade 17 collects toner remaining on the surface of the photosensitive member 10 after the transfer of the toner image from the photosensitive member 10 onto the intermediate transfer belt 30.

Paper sheets S are stored in the cassette 37. The paper sheets S are sent one by one from the cassette 37 to the secondary transfer member 33 through a conveyance path 41 by the timing rollers 40. In time with the sending of each paper sheet S, the control device 101 controls the transfer voltage to be applied to the secondary transfer member 33.

The secondary transfer member 33 is in the form of a roller, and is designed to rotate. The secondary transfer member 33 applies a transfer voltage of the opposite polarity of that of the toner image to the paper sheet S being conveyed. As a result, the toner image is attracted to the secondary transfer member 33 from the intermediate transfer belt 30. Thus, the toner image on the intermediate transfer belt 30 is transferred. The timing of conveyance of the paper sheet S to the secondary transfer member 33 is controlled by the timing rollers 40 in accordance with the position of the toner image on the intermediate transfer belt 30. As a result, the toner image on the intermediate transfer belt 30 is transferred to an appropriate position on the paper sheet S.

The fixing device 50 includes a heating roller 51 and a pressure roller 52. The fixing device 50 causes the paper sheet S to pass through the portion between the heating roller 51 and the pressure roller 52, and applies pressure and heat to the paper sheet S. As a result, the toner image transferred onto the paper sheet S is fixed to the paper sheet S. After that, the paper sheet S is discharged onto a tray 48.

The cleaning blade 42 is pressed against the intermediate transfer belt 30. The cleaning blade 42 collects toner remaining on the surface of the intermediate transfer belt 30 after the transfer of the toner image from the intermediate transfer belt 30 onto the paper sheet S. The collected toner is conveyed by a conveyance screw (not shown), and is stored into a toner waste container (not shown).

[Current Range Setting Screen]

Figure 3:
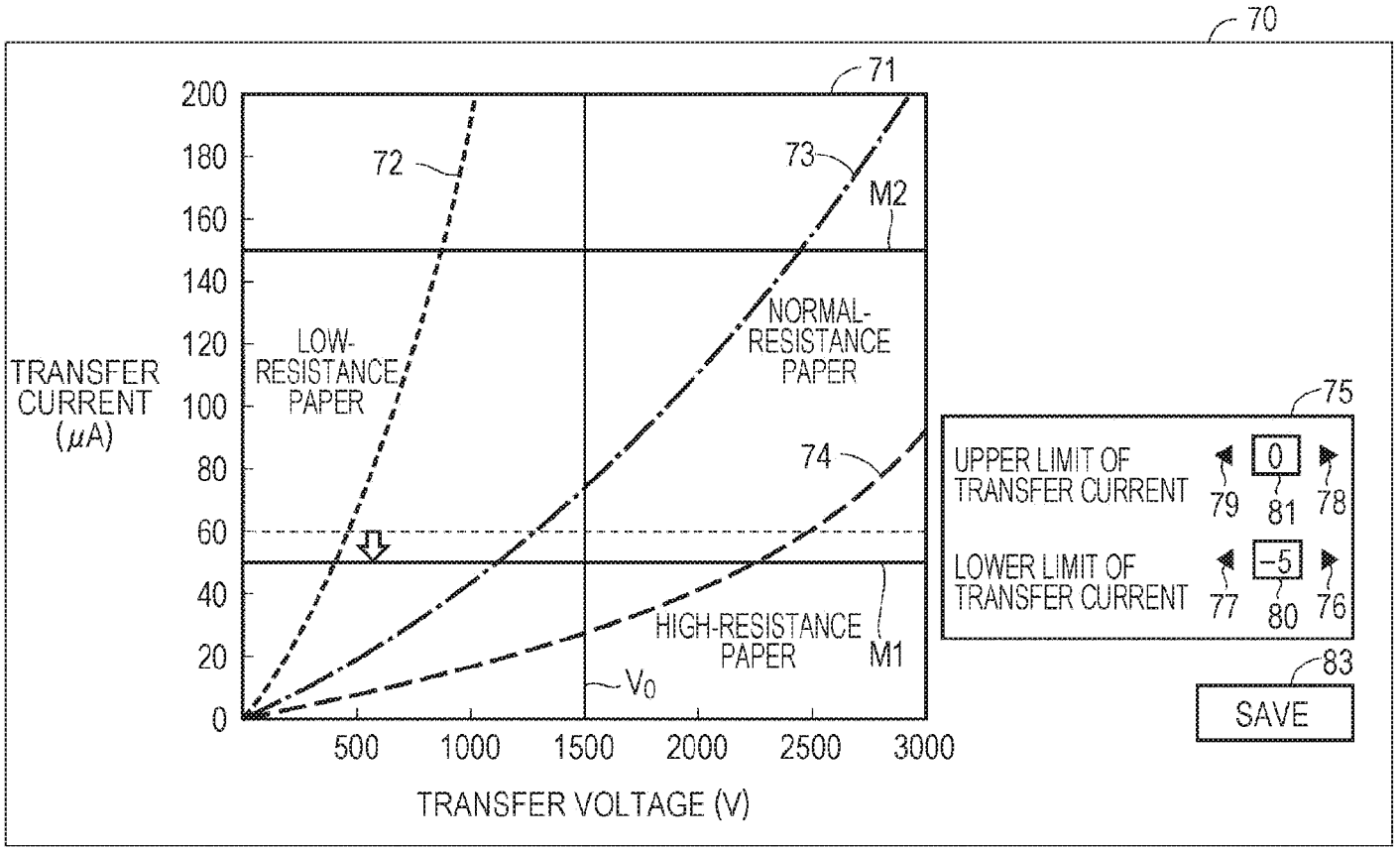
FIG. 3 is a diagram showing a setting screen that is an example of an accepting unit.

Referring now to FIG. 3, an example of the accepting unit 34 (see FIG. 1) that accepts a setting of a current range is described. FIG. 3 is a diagram showing a setting screen 70 that is an example of the accepting unit 34.

The setting screen 70 accepts a setting for changing a preset current range to a new current range. As shown in FIG. 3, the setting screen 70 includes a graph 71 and an input region 75. The setting screen 70 is displayed on a display unit of a later described operation panel 107 (see FIG. 10), for example.

The graph 71 shows correlations 72 through 74, the lower limit M1 of the current range, the upper limit M2 of the current range, and an initial voltage $V_0$. The initial voltage $V_0$ will be described later in detail. The correlation 72 indicates the relationship between the transfer voltage and the transfer current in the case of low-resistance paper. The correlation 73 indicates the relationship between the transfer voltage and the transfer current in the case of normal-resistance paper. The correlation 74 indicates the relationship between the transfer voltage and the transfer current in the case of high-resistance paper. As shown in the graph 71, as the resistance of the paper sheet becomes higher, the increase in the transfer current relative to an increase in the transfer voltage becomes smaller.

The user can input the lower limit M1 of the transfer current and the upper limit M2 of the transfer current to the input region 75. Buttons 76 through 79 are displayed in the input region 75. When the button 76 is pressed, the lower limit M1 becomes higher. When the button 77 is pressed, the lower limit M1 becomes lower. When the button 78 is pressed, the upper limit M2 becomes higher. When the button 79 is pressed, the upper limit M2 becomes lower. The user can also input the lower limit M1 directly to a text box 80. The user can input the upper limit M2 directly to a text box 81. The display of the lower limit M1 and the upper limit M2 in the graph 71 preferably changes with values that are input to the input region 75.

The lower limit M1 and the upper limit M2 shown in the graph 71 are proportional to values that are input to the input region 75. In the example shown in FIG. 3, "−5" is input as an input value of the lower limit M1 in the input region 75. With this input, the lower limit M1 in the graph 71 decreases from 60 μA to 50 μA. That is, every time the input value in the input region 75 becomes lower by "1", the lower limit M1 shown in the graph 71 becomes lower by "2 μA".

The image forming apparatus 100 preferably has a setting mode as an operation mode. While the operation mode of the image forming apparatus 100 is the setting mode, the setting screen 70 accepts a change of the preset current range. That is, when the user selects the setting mode as the operation mode, the image forming apparatus 100 displays the setting screen 70.

When the user presses a save button 83, the image forming apparatus 100 saves the lower limit M1 and the upper limit M2 input to the input region 75 as the current range. It is not necessary to set both the lower limit M1 and the upper limit M2, and it is possible to set only either the lower limit M1 or the upper limit M2. The setting screen 70 accepts a change of the preset current range by newly accepting a lower limit M1 of the transfer current and/or an upper limit M2 of the transfer current.

As the current range is set in the above manner, the user can conduct printing with desired image quality. Noise that adversely affects image quality may be roughness or white dots, for example. However, some users allow such noise. For example, some users prefer to reduce roughness but allow white dots. As the current range is set in the above manner, users can achieve any desired image quality.

Although the setting screen 70 has been described above as an example of the accepting unit 34, the accepting unit 34 is not necessarily the setting screen 70. For example, the accepting unit 34 may be a settings file in which the lower limit M1 of the transfer current and the upper limit M2 of the transfer current are specified. In this case, the user sets the lower limit M1 and the upper limit M2 of the transfer current in the settings file. The settings file is stored in a later described storage device 120 (see FIG. 10), for example.

[Transfer Voltage Control Process]

Figure 4:
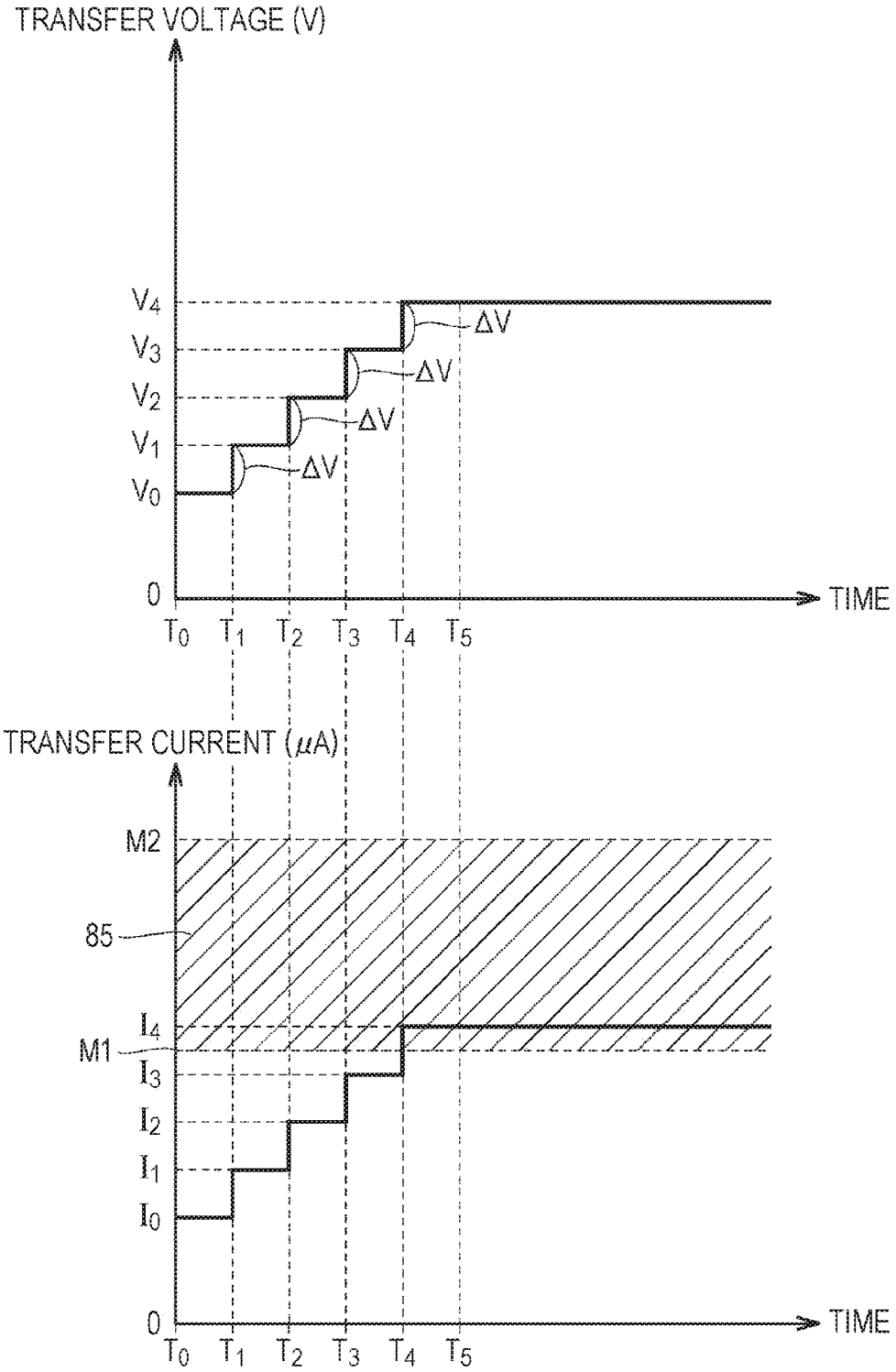
FIG. 4 shows graphs indicating temporal changes in transfer voltage and transfer current.
Figure 5:
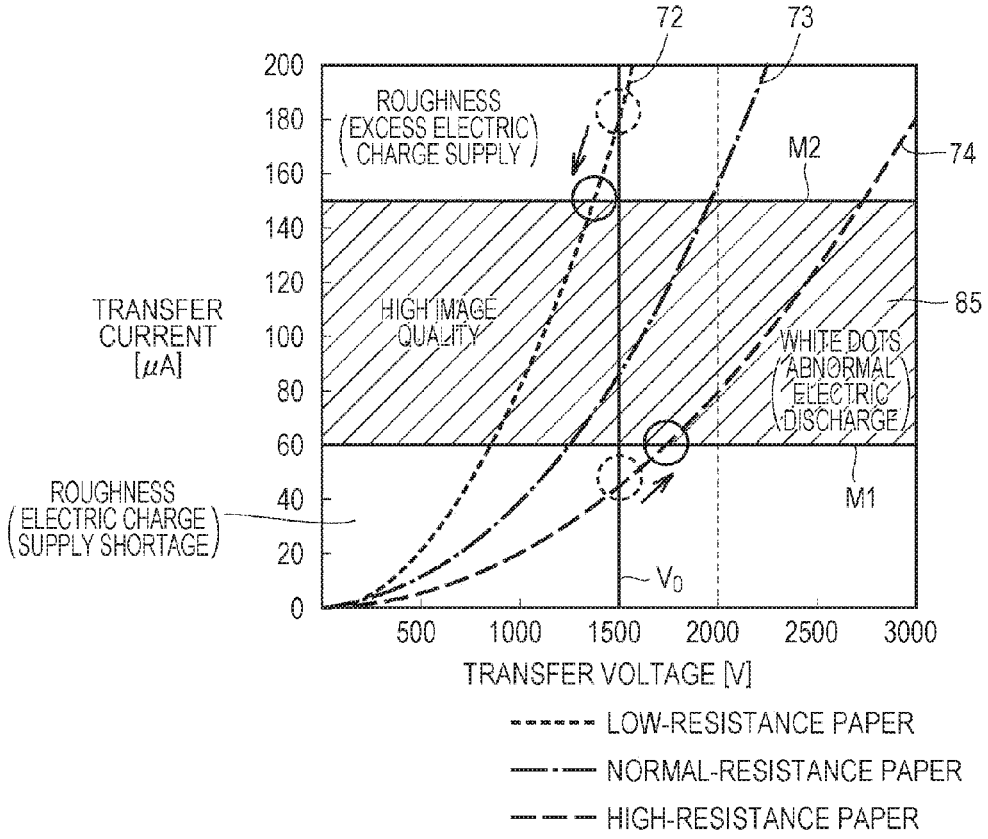
FIG. 5 shows a graph indicating the correlations between the transfer voltage and the transfer current.

As described above, the control device 101 (see FIG. 1) controls the transfer voltage so that the transfer current falls within the current range. Referring now to FIGS. 4 and 5, a transfer voltage control process to be performed by the control device 101 is described. FIG. 4 shows graphs indicating temporal changes in the transfer voltage and the transfer current. FIG. 5 shows a graph indicating the correlations between the transfer voltage and the transfer current.

As shown in FIG. 4, the control device 101 gradually changes the transfer voltage from the preset initial voltage $V_0$, so that the magnitude of the transfer current falls within a newly set current range. The initial voltage $V_0$ is determined beforehand by auto transfer voltage control (ATVC), for example. ATVC is a control method for automatically determining the initial value of a transfer voltage. More specifically, the image forming apparatus 100 that uses ATVC causes a constant current to flow between the intermediate transfer belt 30 (see FIG. 1) and the secondary transfer member 33 (see FIG. 1), and calculates the resistance value between the intermediate transfer belt 30 and the secondary transfer member 33 from the voltage generated at the time. After that, in accordance with a preset table in which the correlations between resistance values and transfer voltages are specified, the image forming apparatus 100 identifies the transfer voltage corresponding to the calculated resistance value, and determines the identified transfer voltage to be the initial voltage $V_0$.

At time $T_0$, the top edge of a paper sheet reaches the contact portion between the intermediate transfer belt 30 and the secondary transfer member 33. Because of this, the control device 101 applies the initial voltage $V_0$ to the paper sheet. As a result, a transfer current $I_0$ flows in the paper sheet.

At time $T_1$, the control device 101 compares a current range 85 with the transfer current $I_0$. Since the magnitude of the transfer current $I_0$ is smaller than the lower limit M1 of the current range 85, the control device 101 increases the transfer voltage by a constant value ΔV. Accordingly, the transfer voltage increases from the initial voltage $V_0$ to a voltage $V_1$. As a result, a transfer current $I_1$ flows in the paper sheet.

At time $T_2$, the control device 101 compares the current range 85 with the transfer current $I_1$. Since the magnitude of the transfer current $I_1$ is smaller than the lower limit M1 of the current range 85, the control device 101 increases the transfer voltage by the constant value ΔV. Accordingly, the transfer voltage increases from the voltage $V_1$ to a voltage $V_2$. As a result, a transfer current $I_2$ flows in the paper sheet.

At time $T_3$, the control device 101 compares the current range 85 with the transfer current $I_2$. Since the magnitude of the transfer current $I_2$ is smaller than the lower limit M1 of the current range 85, the control device 101 increases the transfer voltage by the constant value ΔV. Accordingly, the transfer voltage increases from the voltage $V_2$ to a voltage $V_3$. As a result, a transfer current $I_3$ flows in the paper sheet.

At time $T_4$, the control device 101 compares the current range 85 with the transfer current $I_3$. Since the magnitude of the transfer current $I_3$ is smaller than the lower limit M1 of the current range 85, the control device 101 increases the transfer voltage by the constant value ΔV. Accordingly, the transfer voltage increases from the voltage $V_3$ to a voltage $V_4$. As a result, a transfer current $I_4$ flows in the paper sheet.

At time $T_5$, the control device 101 compares the current range 85 with the transfer current $I_4$. Since the magnitude of the transfer current $I_4$ is greater than the lower limit M1 of the current range 85, the control device 101 maintains the transfer voltage at this point of time. In this manner, the control device 101 increases the transfer voltage from the initial voltage $V_0$ by the constant value ΔV each time, so that the transfer current falls within the current range 85.

The control device 101 preferably controls the transfer voltage after determining whether the paper sheet to be subjected to printing is high-resistance paper. More specifically, when the transfer current at the time of application of the initial voltage $V_0$ is smaller than the lower limit M1 of the current range 85, the control device 101 determines that the paper sheet to be subjected to printing is high-resistance paper, as shown in FIG. 5. After determining that the paper sheet to be subjected to printing is high-resistance paper, the control device 101 repeatedly increases the transfer voltage until the transfer current becomes greater than the lower limit M1 of the current range 85.

In the example shown in FIG. 5, the transfer voltage is repeatedly increased until the transfer current exceeds 60 μA. As a result, the transfer voltage reaches 2000 V. After the transfer current exceeds 60 μA, the control device 101 maintains the transfer voltage at 2000 V. If the transfer current again becomes lower than 60 μA before the printing is completed, the control device 101 cancels the maintenance of the transfer voltage, and again repeats the sensing of the transfer current and the adjustment of the transfer voltage until the transfer current becomes 60 μA or greater.

More preferably, the control device 101 controls the transfer voltage after determining whether the paper sheet to be subjected to printing is low-resistance paper. When the transfer current at the time of application of the initial voltage $V_0$ is greater than the upper limit M2 of the current range 85, the control device 101 determines that the paper sheet to be subjected to printing is low-resistance paper. After determining that the paper sheet to be subjected to printing is low-resistance paper, the control device 101 repeatedly lowers the transfer voltage until the transfer current becomes smaller than the upper limit M2 of the current range 85.

In the example shown in FIG. 5, the transfer voltage is repeatedly lowered until the transfer current becomes lower than 150 μA. As a result, the transfer voltage is lowered to 1300 V. After the transfer current becomes lower than 150 μA, the control device 101 maintains the transfer voltage at 1300 V. If the transfer current again becomes higher than 150 μA before the printing is completed, the control device 101 cancels the maintenance of the transfer voltage, and again repeats the sensing of the transfer current and the adjustment of the transfer voltage until the transfer current becomes 150 μA or smaller.

When the transfer current at the time of application of the initial voltage $V_0$ is not smaller than the lower limit M1 of the current range 85 and not greater than the upper limit M2 of the current range 85, the control device 101 determines that the paper sheet to be subjected to printing is normal-resistance paper. After determining that the paper sheet to be subjected to printing is normal-resistance paper, the control device 101 does not change the transfer voltage at this point of time, and maintains the transfer current at this point of time.

[Variation of the Initial Voltage $V_0$]

Figure 6:
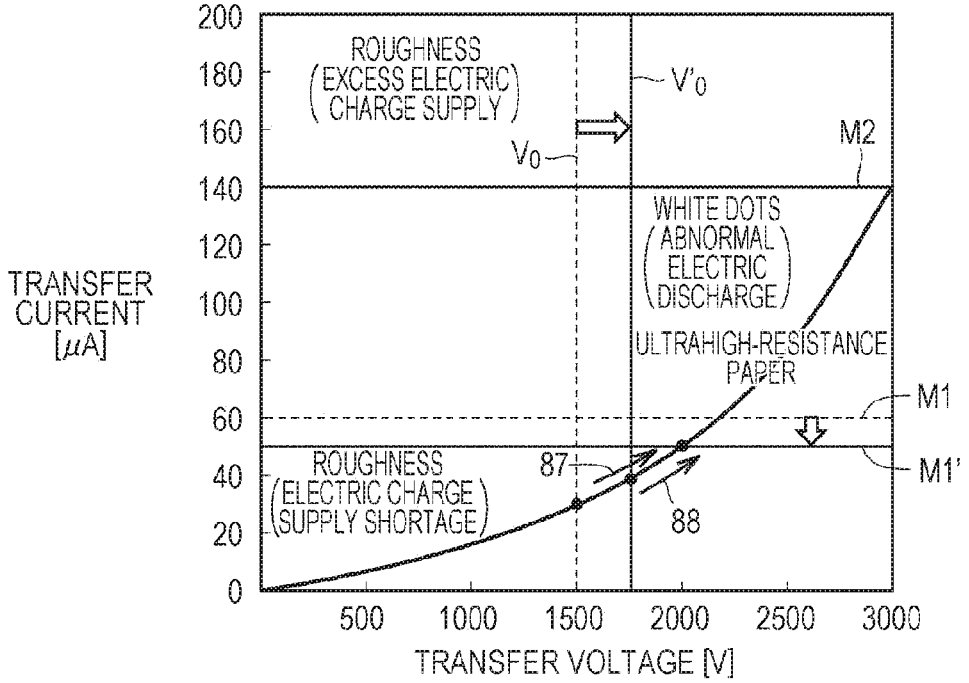
FIG. 6 is a graph showing the initial voltage that varies with the setting of the lower limit of a current range.
Figure 7:
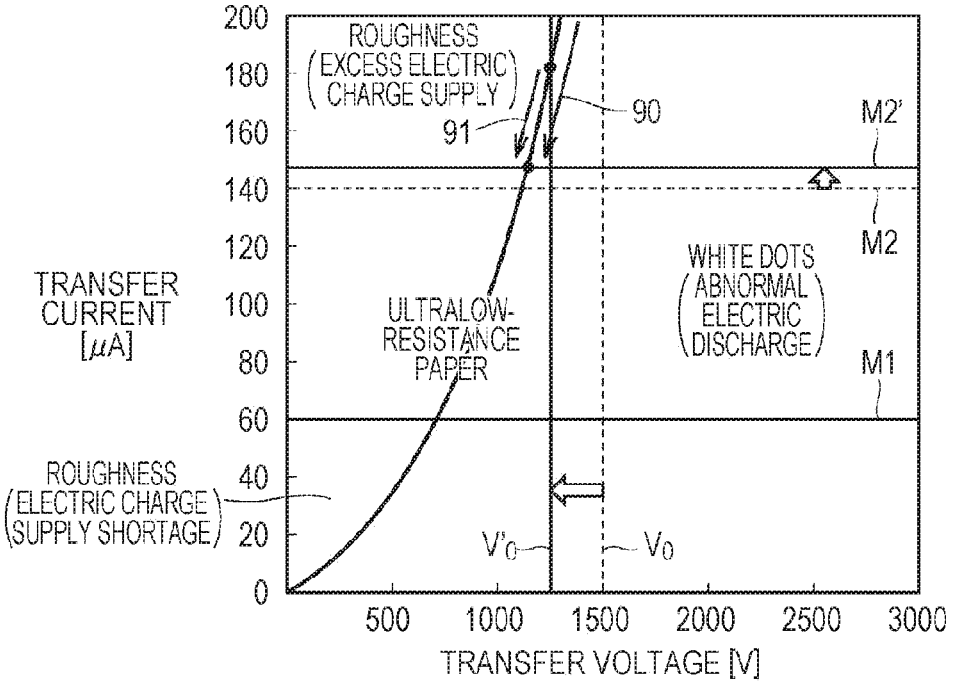
FIG. 7 is a graph showing the initial voltage that varies with the setting of the upper limit of a current range.

Referring now to FIGS. 6 and 7, the initial voltage $V_0$ is further described. FIG. 6 is a graph showing the initial voltage $V_0$ that varies with the setting of the lower limit M1 of a current range. FIG. 7 is a graph showing the initial voltage $V_0$ that varies with the setting of the upper limit M2 of a current range.

As described above, the control device 101 gradually changes the transfer voltage from the preset initial voltage $V_0$, so that the magnitude of the current flowing between the intermediate transfer belt 30 and the secondary transfer member 33 falls within a newly set current range. The magnitude of the initial voltage $V_0$ varies with change that is made to the preset current range.

More specifically, the user may change the lower limit M1 of the transfer current to a lower limit M1', for example, as shown in FIG. 6. In this case, the control device 101 changes the initial voltage $V_0$ to an initial voltage $V_0'$ in accordance with the change from the lower limit M1 to the lower limit M1'. In the example shown in FIG. 6, the user has changed the lower limit M1 of the transfer current from 60 μA to 50 μA, and accordingly, the initial voltage $V_0$ has been increased from 1500 V to 1700 V.

The control device 101 starts adjusting the transfer voltage at the changed initial voltage $V_0'$, and repeats the adjustment of the transfer voltage until the transfer current exceeds the lower limit M1'. The transfer current is adjusted in real time when printing is performed on the paper sheet. Because of this, the transfer current is also adjusted while the paper sheet passes through the contact portion between the intermediate transfer belt 30 (see FIG. 1) and the secondary transfer member 33 (see FIG. 1). As a result, a time lag is generated between the time when the top edge of the paper sheet reaches the contact portion and the time when the transfer current is adjusted to an optimum transfer current. The time required for the transfer current to exceed the lower limit M1' is shorter in a case where the transfer voltage adjustment is started at the initial voltage $V_0'$ than in a case where the transfer voltage adjustment is started at the initial voltage $V_0$ (as indicated by arrows 87 and 88). With this, the image forming apparatus 100 can also increase image quality at the top edge of the paper sheet.

As shown in FIG. 7, the user may change the upper limit M2 of the transfer current to an upper limit M2', for example. In this case, the control device 101 changes the initial voltage $V_0$ to an initial voltage $V_0'$ in accordance with the change from the upper limit M2 to the upper limit M2'. In the example shown in FIG. 7, the user has changed the upper limit M2 of the transfer current from 150 μA to 160 μA, and accordingly, the initial voltage $V_0$ has been lowered from 1500 V to 1300 V.

The control device 101 starts adjusting the transfer voltage at the initial voltage $V_0'$, and repeats the adjustment of the transfer voltage until the transfer current becomes lower than the upper limit M2'. The time required for the transfer current to become lower than the upper limit M2' is shorter in a case where the transfer voltage adjustment is started at the initial voltage $V_0'$ than in a case where the transfer voltage adjustment is started at the initial voltage $V_0$ (as indicated by arrows 90 and 91). With this, the image forming apparatus 100 can also increase image quality at the top edge of the paper sheet.

In the above manner, the control device 101 causes the initial voltage to vary with the setting of the current range. When the lower limit M1 of the current range is changed, the control device 101 preferably increases the initial voltage. When the upper limit M2 of the current range is changed, the control device 101 preferably lowers the initial voltage.

[Adjustment Amounts of Transfer Voltage and Transfer Current]

As the magnitude of the transfer current changes with printing conditions, the degree of change of the transfer current also changes with printing conditions. In view of this, to further increase print precision, the transfer current and the transfer voltage are preferably adjusted in accordance with printing conditions.

Referring now to FIG. 8, a method of determining adjustment amounts of the transfer current and the transfer voltage in accordance with printing conditions is described. FIG. 8 is a table showing the contents of printing information 124.

In the printing information 124, current adjustment amounts and voltage adjustment amounts are associated with each set of printing conditions. The printing conditions for a paper sheet include the sheet conveyance speed, the type of the paper sheet, the printing side, the sheet width, the coverage, and the environment at the time of printing. The coverage indicates the proportion of the area of the toner image in the area of the paper sheet. The environment at the time of printing is indicated by the temperature and the humidity of the inside of the image forming apparatus 100, for example.

Each current adjustment amount specified in the printing information 124 indicates an amount of change in transfer current with respect to a value input to the current range setting screen 70 (see FIG. 3). Each current adjustment amount is specified with respect to both the lower limit M1 and the upper limit M2 of a current range. In a case where the current adjustment amount at the lower limit M1 of a current range is 5 μA, for example, the lower limit M1 of the current range changes by 5 μA every time the value input to the setting screen 70 changes by "1". In a case where the current adjustment amount at the upper limit M2 of a current range is 30 μA, the upper limit M2 of the current range changes by 30 μA every time the value input to the setting screen 70 changes by "1".

Each voltage adjustment amount specified in the printing information 124 is equivalent to the constant value ΔV shown in FIG. 4. As described above, the control device 101 changes the transfer voltage by the constant value ΔV each time when adjusting the transfer current. From the printing information 124, the image forming apparatus 100 obtains the voltage adjustment amount associated with the printing conditions at the time of printing on a paper sheet. When adjusting the transfer current, the image forming apparatus 100 changes the transfer voltage by the obtained voltage adjustment amount each time.

As described above, voltage adjustment amounts associated with the respective sets of printing conditions that differ from one another are stored as the printing information 124 in the image forming apparatus 100. The printing information 124 is stored in the later described storage device 120 (see FIG. 10), for example. From the printing information 124, the control device 101 obtains the voltage adjustment amount associated with the printing conditions for the paper sheet to be subjected to printing. As the control device 101 changes the transfer voltage by the obtained voltage adjustment amount each time, the magnitude of the transfer current flowing between the intermediate transfer belt 30 and the secondary transfer member 33 falls within the newly set current range. With this, the image forming apparatus 100 can change the transfer voltage in accordance with printing conditions, and further increase print quality.

The sheet conveyance speed, the type of the paper sheet, the printing side, and the sheet width are obtained from the print settings that are set at the time of printing. The environment in the image forming apparatus 100 is determined in accordance with a temperature sensor (not shown), a humidity sensor (not shown), and the like installed in the image forming apparatus 100. The coverage of a paper sheet is calculated in accordance with an image obtained by taking an image of the toner image.

Although the printing information 124 is shown as a table in FIG. 8, the printing information 124 is not necessarily expressed as a table. For example, the printing information 124 may be shown as relational expressions that indicate the printing conditions as explanatory variables, and current adjustment amounts or voltage adjustment amounts as objective variables.

[Control Structure of the Image Forming Apparatus 100]

Figure 9:
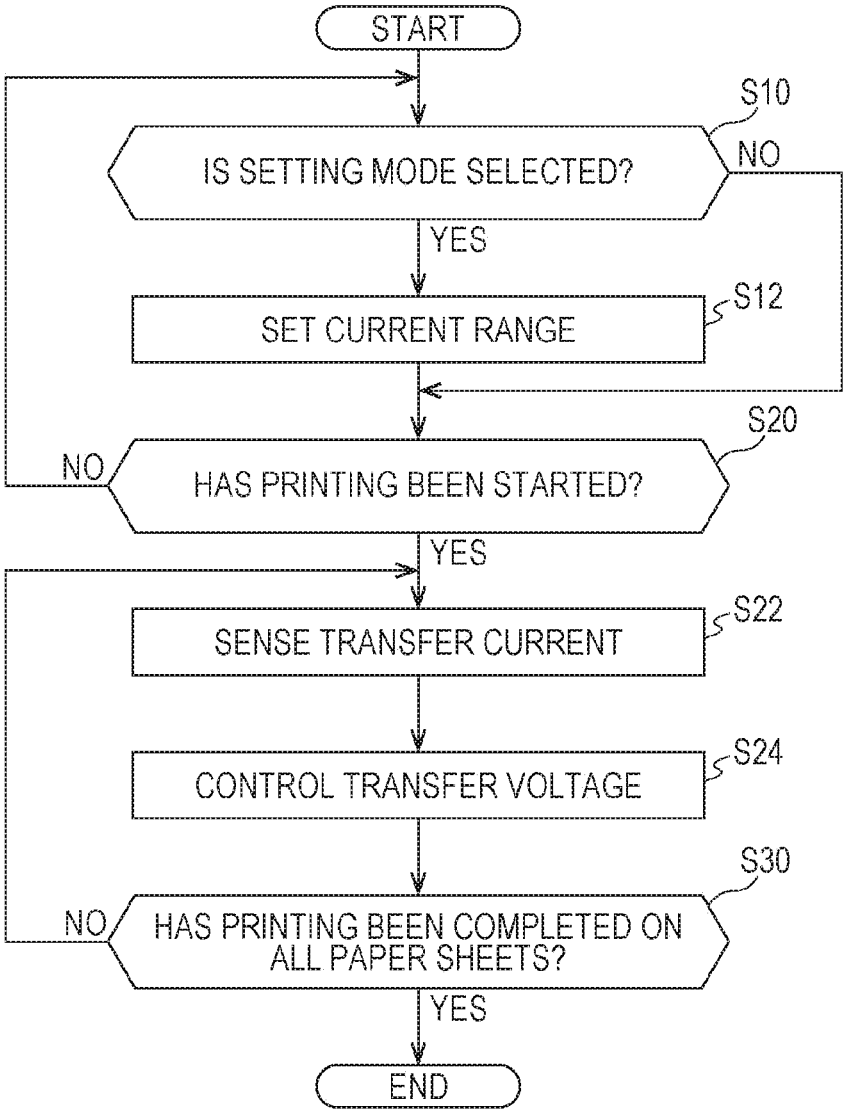
FIG. 9 is a flowchart showing part of a process to be performed by the image forming apparatus.

Referring now to FIG. 9, the control structure of the image forming apparatus 100 is described. FIG. 9 is a flowchart showing part of a process to be performed by the image forming apparatus 100. The process shown in FIG. 9 is performed when the control device 101 executes a program. In other embodiments, part of or all of the process may be performed by a circuit element or some other hardware.

In step S10, the control device 101 determines whether the setting mode is selected as the operation mode of the image forming apparatus 100. The operation mode of the image forming apparatus 100 may be the setting mode, a print mode, a scan mode, or the like. If the control device 101 determines that the setting mode is selected as the operation mode of the image forming apparatus 100 (YES in step S10), the control process is switched to step S12. If the control device 101 determines that the setting mode is not selected (NO in step S10), the control process is switched to step S20.

In step S12, the control device 101 accepts a setting to change a preset current range to a new current range. The preset current range is defined by the lower limit M1 of the transfer current flowing in the paper sheet passing through the contact portion between the intermediate transfer belt 30 (see FIG. 1) and the secondary transfer member 33 (see FIG. 1), and/or the upper limit M2 of the transfer current.

In step S20, the control device 101 determines whether printing has been started. If the control device 101 determines that printing has been started (YES in step S20), the control process is switched to step S22. If the control device 101 determines that printing has not been started (NO in step S20), the control process returns to step S10.

In step S22, the control device 101 senses the magnitude of the transfer current flowing in the transfer target member passing through the contact portion between the intermediate transfer belt 30 (see FIG. 1) and the secondary transfer member 33 (see FIG. 1).

In step S24, the control device 101 controls the transfer voltage so that the magnitude of the transfer current sensed in step S22 falls within the current range. More specifically, if the transfer current is smaller than the lower limit M1 of the current range, the control device 101 increases the transfer voltage. If the transfer current is greater than the upper limit M2 of the current range, the control device 101 lowers the transfer voltage.

In step S30, the control device 101 determines whether printing has been completed on all the paper sheets. If the control device 101 determines that printing has been completed on all the paper sheets (YES in step S30), the transfer voltage control process comes to an end. If the control device 101 determines that printing has not been completed on all the paper sheets (NO in step S30), the control process returns to step S22.

By virtue of the procedure in step S30, the steps S22 and S24 are repeated until printing is completed. In this manner, the sensing of the transfer current and the control of the transfer voltage are repeated until the transfer current falls within the current range.

[Hardware Configuration of the Image Forming Apparatus 100]

Figure 10:
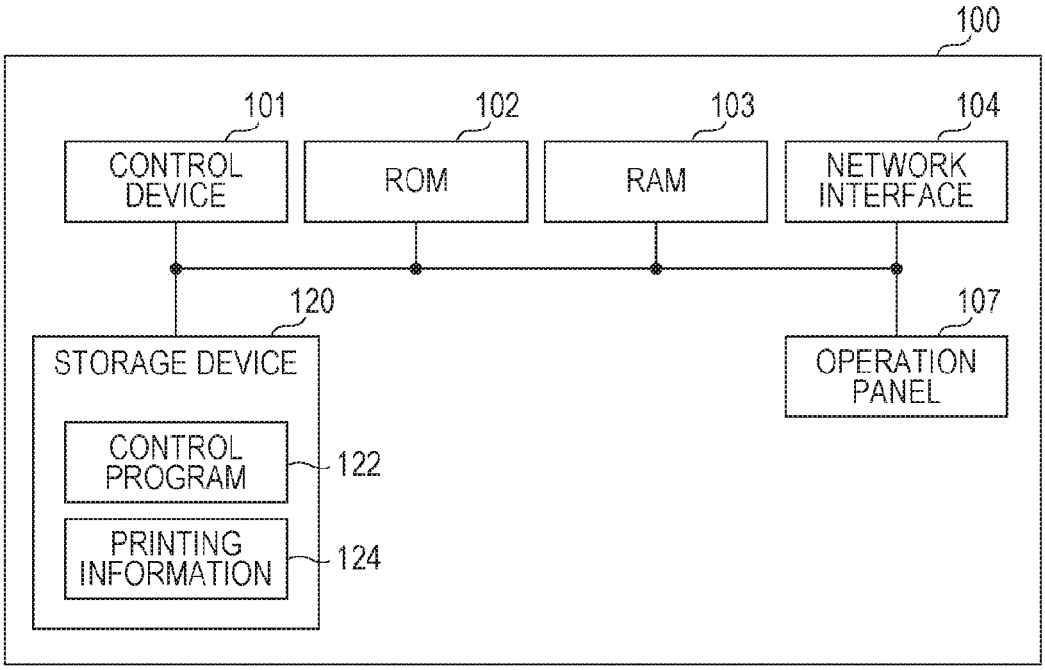
FIG. 10 is a block diagram showing the principal hardware configuration of the image forming apparatus.

Referring now to FIG. 10, an example of the hardware configuration of the image forming apparatus 100 is described. FIG. 10 is a block diagram showing the principal hardware configuration of the image forming apparatus 100.

As shown in FIG. 10, the image forming apparatus 100 includes the control device 101, a read only memory (ROM) 102, a random access memory (RAM) 103, a network interface 104, the operation panel 107, and the storage device 120.

The control device 101 is formed with at least one integrated circuit, for example. An integrated circuit is formed with at least one central processing unit (CPU), at least one application specific integrated circuit (ASIC), at least one field programmable gate array (FPGA), or a combination of these circuits.

The control device 101 controls operation of the image forming apparatus 100 by executing various programs, such as a control program 122 according to this embodiment. Upon receipt of an instruction to execute the control program 122, the control device 101 reads the control program 122 from the storage device 120 into the ROM 102. The RAM 103 functions as a working memory, and temporarily stores various kinds of data necessary for executing the control program 122.

An antenna (not shown) or the like is connected to the network interface 104. The image forming apparatus 100 exchanges data with external communication devices via the antenna. Examples of such external communication devices include mobile communication terminals, such as smartphones, and servers. The image forming apparatus 100 may be designed to download the control program 122 from a server via the antenna.

The operation panel 107 is formed with a display unit and a touch panel. The display unit and the touch panel are overlapped on each other, and the operation panel 107 accepts a touch operation performed on the display unit. The operation panel 107 accepts a print operation, a scan operation, and the like for the image forming apparatus 100. The display unit displays the current range setting screen 70 (see FIG. 3) and the like.

The storage device 120 is a storage medium, such as a hard disk or an external storage device. The storage device 120 stores the control program 122 according to this embodiment, the printing information 124 (see FIG. 10), and the like. The location of storage of the printing information 124 is not necessarily the storage device 120. The printing information 124 may be stored in a storage area (such as a cache) in the control device 101, the ROM 102, the RAM 103, an external device (such as a server), or the like.

The control program 122 may not be provided as a single program, but may be incorporated into any appropriate program. In that case, the control process according to this embodiment is performed in cooperation with any appropriate program. Even such a program that does not include some module does not depart from the scope of the control program 122 according to this embodiment. Further, some function(s) or all of the functions to be provided by the control program 122 may be provided by special-purpose hardware. Alternatively, the image forming apparatus 100 may be in the form a cloud service, and at least one server performs part of the process according to the control program 122.

SUMMARY

In the above described manner, the image forming apparatus 100 accepts a setting of a current range that indicates the variation range of the transfer current. In a case where printing is to be performed on a paper sheet with an unexpectedly high resistance value (a paper sheet with poor quality, for example), print quality can be more efficiently controlled with a change in the transfer current than with a change in the transfer voltage. Accordingly, the user of the image forming apparatus 100 and the maintenance staff for the image forming apparatus 100 can greatly change print quality by setting a current range. In this manner, the number of times test printing needs to be performed to achieve desired print quality can be reduced. Thus, the workload can be reduced.

Although the present invention has been described and illustrated in detail, it is clearly understood that the same is by way of illustrated and example only and is not to be taken byway of limitation, the scope of the present invention being interpreted by terms of the appended claims. It should be understood that equivalents of the claimed inventions and all modifications thereof are incorporated herein.

What is claimed is:

1. An image forming apparatus comprising:

an image carrier configured to carry a toner image;

a transfer member configured to transfer the toner image from the image carrier onto a transfer target member by applying a transfer voltage of the opposite polarity of the polarity of the toner image to the transfer target member passing through a portion in contact with the image carrier, the transfer member being in contact with the image carrier;

an accepting unit configured to accept a setting for changing a preset current range to a new current range, the preset current range being defined by at least one of a lower limit of a current flowing in the transfer target member passing through the contact portion between the image carrier and the transfer member and an upper limit of the current;

a sensing unit configured to sense a magnitude of the current flowing in the transfer target member passing through the contact portion between the image carrier and the transfer member; and a control device configured to control the transfer voltage so that the magnitude of the current sensed by the sensing unit falls within the new current range.

2. The image forming apparatus according to claim 1, wherein the image forming apparatus has a setting mode as an operation mode, and the accepting unit accepts a change of the preset current range while the operation mode is the setting mode.

3. The image forming apparatus according to claim 1, wherein the accepting unit accepts a change of the preset current range by accepting at least one of a new lower limit of the current and a new upper limit of the current.

4. The image forming apparatus according to claim 1, wherein the control device gradually changes the transfer voltage from a predetermined initial voltage so that the magnitude of the current flowing between the transfer member and the image carrier falls within the new current range, and a magnitude of the initial voltage varies with a change of the preset current range.

5. The image forming apparatus according to claim 1, further comprising a storage device storing printing information, the printing information being voltage adjustment amounts associated with a plurality of sets of printing conditions, the sets being different from one another, wherein the control device obtains, from the printing information, the voltage adjustment amount associated with the set of the printing conditions for the transfer target member to be subjected to printing, and changes the transfer voltage by the voltage adjustment amount each time so that the magnitude of the current flowing between the transfer member and the image carrier falls within the new current range.

6. A method of controlling an image forming apparatus, the image forming apparatus including:

an image carrier configured to carry a toner image; and a transfer member configured to transfer the toner image from the image carrier onto a transfer target member by applying a transfer voltage of the opposite polarity of the polarity of the toner image to the transfer target member passing through a portion in contact with the image carrier, the transfer member being in contact with the image carrier, the method comprising:

a step of accepting a setting for changing a preset current range to a new current range, the preset current range being defined by at least one of a lower limit of a current flowing in the transfer target member passing through the contact portion between the image carrier and the transfer member and an upper limit of the current;

a step of sensing a magnitude of the current flowing in the transfer target member passing through the contact portion between the image carrier and the transfer member; and a step of controlling the transfer voltage so that the magnitude of the current sensed by the sensing unit falls within the new current range.

7. The control method according to claim 6, wherein the image forming apparatus has a setting mode as an operation mode, and the accepting step includes accepting a change of the preset current range while the operation mode is the setting mode.

8. The control method according to claim 6, wherein the accepting step includes accepting a change of the preset current range by accepting at least one of a new lower limit of the current and a new upper limit of the current.

9. The control method according to claim 6, wherein the controlling step includes gradually changing the transfer voltage from a predetermined initial voltage so that the magnitude of the current flowing between the transfer member and the image carrier falls within the new current range, and a magnitude of the initial voltage varies with a change of the preset current range.

10. The control method according to claim 6, wherein the image forming apparatus further includes a storage device storing printing information, the printing information being voltage adjustment amounts associated with a plurality of sets of printing conditions, the sets being different from one another, and the controlling step includes obtaining, from the printing information, the voltage adjustment amount associated with the set of the printing conditions for the transfer target member to be subjected to printing, and changing the transfer voltage by the voltage adjustment amount each time so that the magnitude of the current flowing between the transfer member and the image carrier falls within the new current range.

11. A non-transitory recording medium storing a computer readable program for controlling an image forming apparatus, the image forming apparatus including:

an image carrier configured to carry a toner image; and a transfer member configured to transfer the toner image from the image carrier onto a transfer target member by applying a transfer voltage of the opposite polarity of the polarity of the toner image to the transfer target member passing through a portion in contact with the image carrier, the transfer member being in contact with the image carrier, the control program for causing the image forming apparatus to carry out:

a step of accepting a setting for changing a preset current range to a new current range, the preset current range being defined by at least one of a lower limit of a current flowing in the transfer target member passing through the contact portion between the image carrier and the transfer member and an upper limit of the current;

a step of sensing a magnitude of the current flowing in the transfer target member passing through the contact portion between the image carrier and the transfer member; and a step of controlling the transfer voltage so that the magnitude of the current sensed by the sensing unit falls within the new current range.

12. The non-transitory recording medium storing a computer readable program for controlling an image forming apparatus according to claim 11, wherein the image forming apparatus has a setting mode as an operation mode, and the accepting step includes accepting a change of the preset current range while the operation mode is the setting mode.

13. The non-transitory recording medium storing a computer readable program for controlling an image forming apparatus according to claim 11, wherein the accepting step includes accepting a change of the preset current range by accepting at least one of a new lower limit of the current and a new upper limit of the current.

14. The non-transitory recording medium storing a computer readable program for controlling an image forming apparatus according to claim 11, wherein the controlling step includes gradually changing the transfer voltage from a predetermined initial voltage so that the magnitude of the current flowing between the transfer member and the image carrier falls within the new current range, and a magnitude of the initial voltage varies with a change of the preset current range.

15. The non-transitory recording medium storing a computer readable program for controlling an image forming apparatus according to claim 11, wherein the image forming apparatus further includes a storage device storing printing information, the printing information being voltage adjustment amounts associated with a plurality of sets of printing conditions, the sets being different from one another, and the controlling step includes obtaining, from the printing information, the voltage adjustment amount associated with the set of the printing conditions for the transfer target member to be subjected to printing, and changing the transfer voltage by the voltage adjustment amount each time so that the magnitude of the current flowing between the transfer member and the image carrier falls within the new current range.

* * * * *